United States Patent [19]

Peter et al.

[11] Patent Number: 4,842,573

[45] Date of Patent: Jun. 27, 1989

[54] APPARATUS FOR FORMING STACKS OF PANELS IN ZIG-ZAG FORMATION

[75] Inventors: Jürgen Peter, Hamburg; Karl-Heinz Schlottke, Tangstedt, both of Fed. Rep. of Germany

[73] Assignee: E.C.H. Will GmbH, Hamburg, Fed. Rep. of Germany

[21] Appl. No.: 195,075

[22] Filed: May 17, 1988

[30] Foreign Application Priority Data

May 29, 1987 [DE] Fed. Rep. of Germany ..... 3718081

[51] Int. Cl.[4] ..... B65H 45/16; B65H 29/66; B65H 29/24

[52] U.S. Cl. ..... 493/412; 270/39; 198/803.5

[58] Field of Search ..... 493/357, 358, 359, 360, 493/412, 418, 423; 270/30, 39, 52.5; 198/689.1, 803.5

[56] References Cited

U.S. PATENT DOCUMENTS 3,640,521 2/1972 Hutley ..... 493/412
4,650,447 3/1987 Meschi ..... 493/412
4,708,332 11/1987 Besemann ..... 270/39
4,750,724 6/1988 Herd et al. ..... 270/39

*Primary Examiner*—Frederick R. Schmidt
*Assistant Examiner*—Jack Lavinder
*Attorney, Agent, or Firm*—Peter K. Kontler

[57] ABSTRACT

Apparatus for stacking panels of a running web in zig-zag formation by folding the web along transversely extending weakened fold lines has a vertically movable table which supports successive growing stacks at a stacking station and has a concave or convex upper side serving to impart to the panels above it a concavo-convex shape. The fold lines between the panels of the growing stack are pushed downwardly and thereby caused to assume an arcuate shape by a set of rotary folding fingers and by a conveyor which cooperates with a suction chamber and pulls the adjacent fold lines of the growing stack downwardly toward the upper side of the table. The concavo-convex panels of the growing stack are stiffer than plane panels and ensure that the growing stacks resemble parallelepipeds with neighboring sides disposed at right angles to each other and without sagging of panels between the corresponding fold lines.

24 Claims, 3 Drawing Sheets

II
II
18
39
43a
44
41
38
43a
13
37
17
21
19
12
46
16
14
26
18a
2
9
28
7
23
32
31
22
28a
4
6
29
3
11
1
13
33
8
24
34
36

APPARATUS FOR FORMING STACKS OF PANELS IN ZIG-ZAG FORMATION

BACKGROUND OF THE INVENTION

The invention relates to improvements in apparatus for forming stacks of superimposed sheets or panels (hereinafter called panels), and more particularly to improvements in apparatus for forming stacks of coherent panels which are deposited on top of each other in zig-zag formation. Still more particularly, the invention relates to improvements in apparatus of the type wherein a continuous web of paper, metallic foil, plastic foil or other foldable material is or can be provided with transversely extending weakened portions to form fold lines which facilitate folding of neighboring panels relative to each other and wherein the web is or can be manipulated prior to stacking of successive foremost panels so that the panels form a scalloped stream or flow of partially overlapping coherent panels.

It is known to fold a web or strip of coherent panels so as to convert the web into a series of stacks which contain predetermined numbers of coherent panels in zig-zag formation. As a rule, neighboring panels of each stack are connected to each other by weakened fold lines which can contain rows of perforations so as to facilitate separation of neighboring panels from each other in a highly predictable fashion. Such panels are used in word processors and in similar machines and can bear printed matter so that each panel of the stack constitutes a form which can be filled out to constitute a shipping document, a completed questionnaire, a standard cover letter or any other document of a practically unlimited variety of documents which are used by government agencies and private firms. During folding of successive panels of the running web relative to the next-following panels, the panels are normally acted upon by suitable folding instrumentalities which ensure that the folding takes place only along fold lines and in such a way that the panels of the growing stack will pile up to constitute a zig-zag formation.

Problems arise when a conventional stack forming apparatus is called upon to make relatively tall stacks of overlapping panels in zig-zag formation. Thus, a tall stack of panels in zig-zag formation is likely to assume a shape which departs from an optimum form, especially that of a parallelepiped with neighboring sides disposed at right angles to each other. A predetermined shape is desirable for further processing of the stacks, particularly for wrapping and packing in boxes or in other types of receptacles.

One of the reasons that the shape of a relatively tall stack of superimposed panels in zig-zag formation is likely to depart from a predetermined optimum form is that those sides of the stack which are formed by the two rows of fold lines are taller than a section through the center of the stack between such sides. Thus, the central portion of the stack tends to be recessed or depressed (i.e., to sag) so that the panels of the stack are not flat but assume a concavo-convex shape. Each such stack is taller in the regions of the two rows of superimposed fold lines and is shorter in the regions between such sides. This not only interferes with further treatment (such as wrapping and boxing) of the stacks but also interferes with the operation of various components of the stack forming apparatus because such components are designed to operate properly when the shape of the growing stack matches an optimum shape.

OBJECTS AND SUMMARY OF THE INVENTION

An object of the invention is to provide an apparatus which can convert a running web consisting of a series of coherent panels into a succession of stacks of superimposed panels in zig-zag formation in such a way that the configuration of each stack matches or closely approximates a desired optimum shape irrespective of the selected height of the stacks.

Another object of the invention is to provide the apparatus with novel and improved means for preventing sagging of the panels in a growing stack intermediate the fold lines where such panels are connected to neighboring panels.

A further object of the invention is to provide the apparatus with novel and improved means for supporting growing stacks and for evacuating fully grown stacks from the stacking station.

An additional object of the invention is to provide a novel and improved method of manipulating the web of coherent panels ahead of the stacking station and of manipulating fully grown stacks.

Still another object of the invention is to provide an apparatus which can form successive stacks at frequent intervals and which can form a succession of stacks each having the shape of a parallelepiped with neighboring sides making angles of 90 degrees.

A further object of the invention is to provide a novel and improved support for growing and fully grown stacks in the above outlined apparatus.

Another object of the invention is to provide the apparatus with novel and improved means for manipulating the lowermost panels of successive fully grown stacks.

A further object of the invention is to provide the apparatus with novel and improved means for temporarily supporting growing stacks during evacuation of fully grown stacks from the stacking station.

An additional object of the invention is to provide an apparatus which can simultaneously process two or more running webs with the same degree of efficiency and predictability.

The apparatus of the present invention serves to convert a running web of coherent panels into a succession of stacks with superimposed panels in zig-zag formation. The apparatus comprises means for advancing the web longitudinally in a predetermined direction along a predetermined path (e.g., the advancing means can comprise two endless belt conveyors which advance the web along a substantially horizontal path on to a stacking station), means for superimposing successive panels in a predetermined portion of the path (namely at the stacking station) to form a growing stack of superimposed panels in zig-zag formation (such growing stack has a lowermost panel and two rows of fold lines which connect each panel above the lowermost panel to the neighboring panels), and means for supporting the lowermost panel of the growing stack in the predetermined portion of the path. In accordance with a feature of the invention, the supporting means includes means for bending the fold lines of the two rows to thereby impart to the lowermost panel and to at least some panels close to the lowermost panel of the growing stack a substantially concavo-convex configuration. This stiffens the panels and prevents them from sagging in the middle between the respective fold lines. The advancing means can comprise means for transforming the running web into a scalloped stream of partially overlapping panels not later than in a second portion of the path immediately upstream of the predetermined portion (stacking station).

The bending means is preferably provided with an arcuate upper side (it is presently preferred to provide the bending means with a convex upper side) which serves to contact and deform the lowermost panel of the growing stack.

The apparatus preferably further comprises elevator means for moving the supporting means up and down toward and away from the predetermined portion of the path so that the supporting means can lower and can be relieved of a fully grown stack prior to returning to a raised position at the stacking station. The superimposing means preferably comprises a plurality of folding elements which are operative to flex and pack the fold lines of one of the aforementioned rows of fold lines so as to at least substantially conform the curvature of the flexed and packed fold lines of the one row to the curvature of the upper side of the bending means. The fold lines of the one row are preferably those which are located downstream of the fold lines of the other row (as seen in the direction of advancement of the web toward the stacking station). The folding elements can include rotary folding fingers, and the superimposing means then further comprises means for rotating the folding fingers. Such folding fingers preferably include at least one longer and at least one shorter folding finger so as to more readily conform the curvature of fold lines in the one row to the curvature of the arcuate upper side of the bending means. For example, the folding fingers can include two longer and two shorter fingers which are spaced apart from each other to form a file extending transversely of the direction of advancement of the web.

The upper side of the bending means is preferably configurated in such a way that it has a centrally located apex extending in the predetermined direction, and the folding fingers can include a longer finger and a shorter finger at each side of the apex.

The apparatus can be designed to simultaneously convert each of a plurality of running webs into a succession of stacks. The advancing means then comprises means for advancing the webs along discrete substantially parallel predetermined paths, and the supporting means of such apparatus comprises discrete means for bending the fold lines in each growing stack. In order to enhance the simplicity and to reduce the cost of such apparatus, the superimposing means preferably comprises a plurality of rotary folding elements for each bending means and means (e.g., a single horizontal shaft) for rotating all of the folding elements about a common axis.

The advancing means can include a first conveyor which is located above the second portion of the path. Such conveyor can form part of or can be provided in addition to the aforementioned means for transforming the running web into a scalloped stream of partially overlapping panels not later than in the second portion of the path. The first conveyor can constitute an endless belt conveyor with an elongated lower reach contacting the adjacent panels of the scalloped stream and an elongated upper reach which is preferably in line with the aforementioned apex of the arcuate upper side of the bending means. Such upper reach is preferably disposed between two pairs of rotary folding elements, namely a shorter and a longer folding element at each of its sides.

The fold lines are preferably provided in the running web at the time the respective portions or increments of the web reach the first conveyor of the advancing means. The first conveyor can include means for attracting the web in the regions of fold lines in the second portion of the path; such attracting means can include suction ports in the (endless belt) conveyor and a suction chamber communicating with those suction ports of the first conveyor which move along the second portion of the path.

The advancing means preferably further comprises a second endless belt conveyor which is disposed below the second portion of the path immediately upstream of the stacking station and includes a substantially vertical downwardly moving portion adjacent the other row of superimposed fold lines in the growing stack on the bending means of the supporting means, and means for attracting successive fold lines of the other row so as to urge such fold lines downwardly toward the bending means. The attracting means of the second conveyor can include suction ports in the conveyor and a suction chamber which communicates with the suction ports of the downwardly moving portion of the second conveyor.

The bending means of the supporting means preferably includes a plurality of sections which are spaced apart from each other, as seen transversely of the direction of advancement of the web, and define clearances which are parallel to such direction. The apparatus preferably further comprises second or auxiliary supporting means in addition to the aforementioned (main) supporting means, and means for moving the auxiliary supporting means to an operative position beneath the predetermined portion (stacking station) of the path before the elevator means lowers the main supporting means with a fully grown stack thereon so that the auxiliary supporting means can support the foremost panel of the remaining portion of the running web and permits the accumulation of a fresh growing stack. To this end, the auxiliary supporting means can include a plurality of prong-like portions which are receivable in the clearances between the sections of the bending means so that the auxiliary supporting means can enter the stacking station before the main supporting means is lowered in order to remove the fully grown stack thereon from the stacking station. The means for moving the auxiliary supporting means can include a double-acting fluid-operated motor or any other suitable means for reciprocating the auxiliary supporting means in and counter to the predetermined direction. The auxiliary supporting means remains in the operative position from the moment on when the elevator means lowers the main supporting means with the fully grown stack thereon until the main supporting means (after having been relieved of the fully grown stack) returns to a predetermined raised position in which the upper side of the bending means engages from below the lowermost panel of the fresh growing stack on the auxiliary supporting means.

The apparatus further comprises means for separating the topmost panel of a fully grown stack on the main supporting means from the next-following panel of the running web so that the next-following panel and the panels that follow can be piled up on top of each other in zig-zag formation to form the fresh or next growing stack. The main supporting means preferably deposits a fully grown stack on a first conveyor of the evacuating means which is preferably positioned in such a way that the fully grown stack comes to rest on the first conveyor of the evacuating means in automatic response to lowering of the main supporting means. This can be readily achieved if the first conveyor of the evacuating means is a belt conveyor with two or more relatively narrow endless belts whose upper reaches enter the clearances between the sections of the bending means in response to lowering of the main supporting means. The separating means can include means for breaking (e.g., tearing) the web along the fold line between the topmost panel of the fully grown stack and the next-following panel of the web.

The main supporting means can be provided with means for urging the next-following panel of the web upwardly, e.g., into a substantially horizontal plane. This permits proper manipulation of such panel on the evacuating means. The urging means can comprise one or more nozzles which blow compressed air against the underside of the next-following panel of the web.

As mentioned above, the first conveyor of the evacuating means can receive fully grown stacks from the main supporting means while or after the latter descends beneath the stacking station.

The evacuating means preferably further comprises a second conveyor which receives stacks from the first conveyor. The discharge end of the first conveyor of the evacuating means is adjacent the receiving end of the second conveyor and is preferably provided with means (such as a rotary suction wheel) for changing the orientation of the foremost or lowermost panel of a fully grown stack during transfer of such stack from the first one to the second conveyor of the evacuating means.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain specific embodiments with reference to the accompanying drawing.

DESCRIPTION OF PREFERRED EMBODIMENTS

Figure 1:
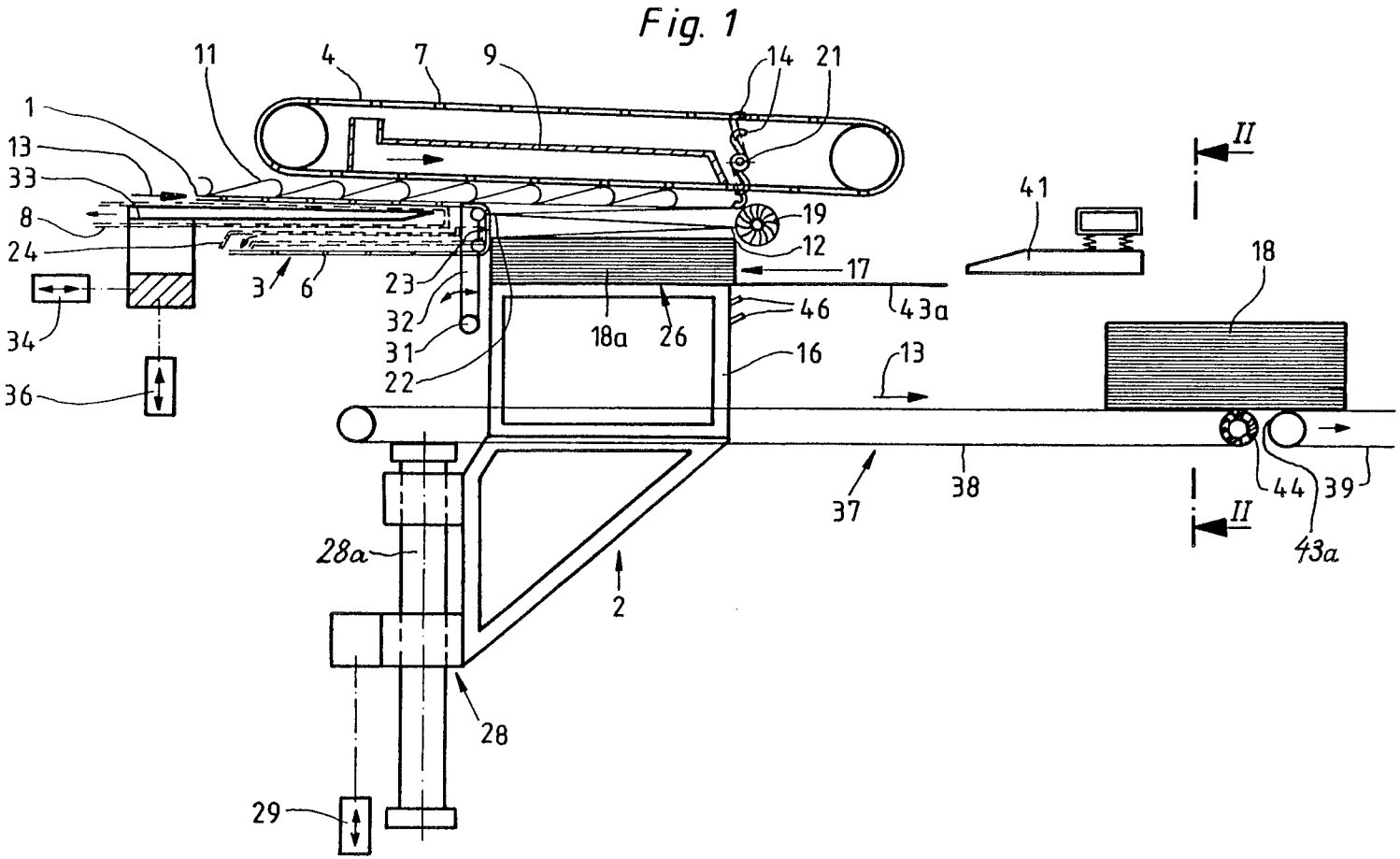
FIG. 1 is a schematic partly elevational and partly vertical sectional view of an apparatus which embodies the invention and is designed for simultaneous processing of five webs of coherent panels, the growing stacks at the stacking stations being supported by the vertically movable main supporting means.
Figure 2:
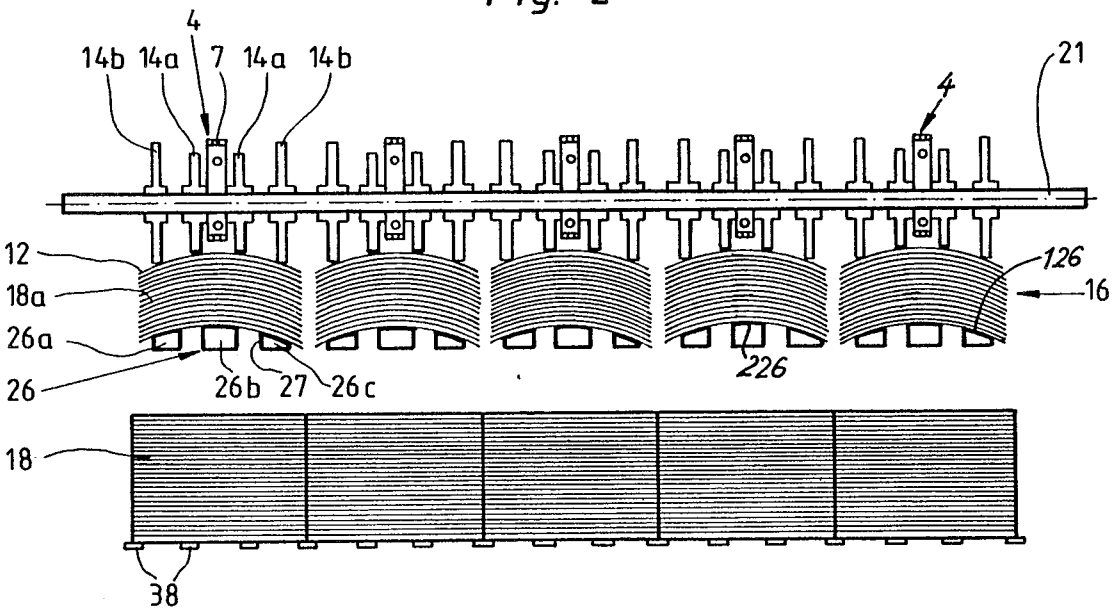
FIG. 2 is a view as seen in the direction of arrows from the line II—II of FIG. 1.
Figure 3:
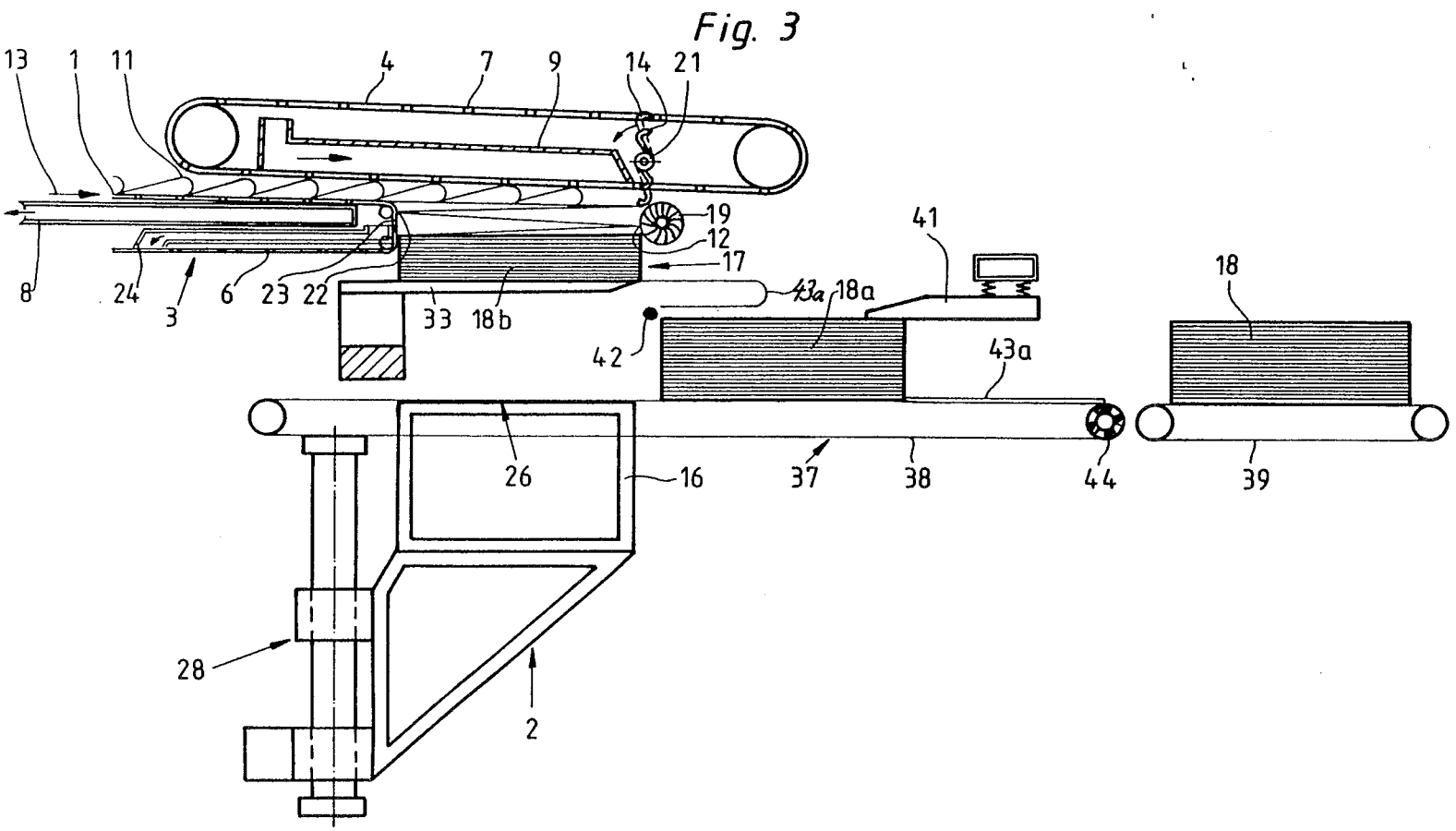
FIG. 3 illustrates the apparatus of FIG. 1 with the main supporting means spaced apart from the growing stack at the stacking station and being already relieved of a fully grown.

The apparatus which is shown in FIGS. 1 to 3 serves to manipulate one or more continuous webs 1 of coherent panels 11 wherein each panel is connected with the preceding panel by a first weakened fold line 12 and with the next-following panel by a weakened fold line 22. The fold lines 12, 22 extend transversely of the direction (arrow 13) of advancement of each web 1 toward the respective portion (stacking station 2) of its path. The illustrated apparatus is designed to simultaneously process five running webs 1 (see FIG. 2) which are caused to advance along parallel paths. This apparatus can form part of a machine or apparatus of the type disclosed in commonly owned U.S. Pat. No. 4,708,332 granted Nov. 24, 1987 to Alfred Besemann for "Method and apparatus for zig-zag folding webs of paper and the like". Another apparatus for stacking the panels of running webs in zig-zag formation is disclosed in commonly owned copending patent application Ser. No. 110,289 filed Oct. 19, 1987 to Karl-Heinz Schlottke et al. for "Method of and apparatus for gathering and manipulating stacked zig-zag formations of paper sheets". The disclosures of the patent to Besemann and of the application of Schlottke et al. are incorporated herein by reference.

FIGS. 1 and 3 show all necessary details of that portion of the improved apparatus which can manipulate one of the five running webs 1. This portion of the apparatus comprises means for advancing the respective web 1 longitudinally along a second portion of its path (upstream of the stacking station 2) in such a way that the web 1 forms a scalloped stream of partially overlapping panels 11. The advancing means comprises a first endless belt conveyor 4 above and a second endless belt conveyor 3 below the second portion of the path of movement of the panels 11 toward the stacking station 2. The means for forming the scalloped stream is or can be the same as that which is disclosed in the aforementioned patent to Besemann. In order to ensure a highly predictable transport of successive panels 11 of the web 1 toward the stacking station 2, the conveyors 3 and 4 are provided with means for attracting the adjacent portions of the panels 11 in the channel between the lower reach of the upper conveyor 4 and the upper reach of the lower conveyor 3. The attracting means of the conveyor 4 comprises spaced-apart suction ports 7 and a suction chamber 9 which is disposed between the upper and lower reahes of the conveyor 4 and communicates with the suction ports 7 in the lower reach. As can be seen in FIGS. 1 and 3, the suction ports 7 in the lower reach of the conveyor 4 draw air into the suction chamber 9 to thus attract the adjacent looped portions of successive panels 11 of the running web 1, namely those portions which are adjacent to but spaced apart from and located behind the fold lines 12 or 22 at the leading ends of the respective panels 11. The suction ports 6 in the upper reach of the lower conveyor 3 draw air into a suction chamber 8 and serve to evacuate air at the concave undersides of the looped panels 11 to thus contribute to a predictable advancement of the web 1 toward and into the stacking station 2. The arrangement is preferably such that the speed of the lower reach of the upper conveyor 4 slightly exceeds the speed of delivery of looped panels 11 into its range; this ensures that the lines where the panels 11 are folded or pivoted relative to each other coincide with the transversely extending weakened portions of the web 1.

Successive panels 11 of the web 1 which reach the stacking station 2 are acted upon by combined folding and packing or stacking elements 14 in the form of fingers **14*a*, 14*b* (see particularly FIG. 2), two at each lateral side of the reaches of the respective conveyor 4. The fingers 14*a*, 14*b* are rotated by a common horizontal shaft 21 which is driven by the main prime mover (not shown) of the machine which embodies the improved apparatus. The folding elements 14 convert alternate weakened portions of the web 1 into pronounced fold lines 12 and cause such fold lines to descend into the range of a driven rotary brush 19 so that successive fold lines 12 jointly form the vertical front side or surface 17 of the stack 18***a* which grows on top of a main supporting means 16 here shown as a vertically movable table having a speially designed top portion 26 constituting a bending means for the adjacent panels 11 of the growing stack 18*a*. The hook-shaped terminals or outer portions of the folding elements 14 act upon the looped portions of the oncoming panels 11. The brush 19 assists the folding elements 14 in forming the vertical row of superimposed fold lines 12 which are closely adjacent one another and together constitute the front side 17 of tee growing stack 18*a*.

FIG. 2 shows that the apparatus comprises discrete advancing means (only the upper conveyors 4 can be seen) for the five webs 1 and that the table 16 includes five bending or deforming means 26, one for each of the five growing stacks at the respective stacking stations. FIG. 2 further shows that all of the (twenty) folding elements 14 can be driven by a common horizontal shaft 21. The folding elements 14 of each set of four folding elements include two relatively short folding fingers 14*a* which are disposed at opposite sides of the upper and lower reaches of the respective conveyors 4, and two longer folding fingers 14*b* which flank the respective pairs of shorter folding fingers 14*a*. The length of each folding element 14 is selected in such a way that these folding elements can impart to successive oncoming fold lines 12 an arcuate shape with a curvature conforming to that of the convex upper side 126 of the respective bending means 26. Each upper side 126 has a substantially centrally located apex 226 which extends in parallelism with the direction (arrow 13) of advancement of the respective web 1 and is thus in line with the upper and lower reaches of the respective conveyor 4. In other words, each apex 226 is located between two pairs of folding elements 14 and each such pair includes a shorter folding finger 14*a* (nearer to the respective apex 226) and a longer folding finger 14*b*. This ensures that the fold lines 12 are bent to conform to the outline of the respective upper side 126 and that the panels 11 of the growing stack 18*a* on the respective bending means 26 have concave undersides and convex upper sides. This, in turn, enhances the rigidity of the panels 11 and renders them less likely to sag between the respective front fold lines 12 and the respective rear fold lines 22 (as seen in the direction of the arrow 13).

In order to ensure an equally reliable stacking and deformation (flexing or bending) of the row of superimposed rear fold lines 22 (which together form the vertical rear side or surface of the growing stack 18*a*), each lower conveyor 3 includes a downwardly moving vertical or nearly vertical portion 23 which is adjacent the open or foraminous side of a further suction chamber 24 serving to draw air into those suction ports 6 of the conveyor 3 which move downwardly along the row of fold lines 22. This compels such fold lines to move downwardly into abutment with the preceding fold lines 22 and to assume the curvature of the rear portion of the respective bending means 26. The provision of suction ports 6 in the conveyor 3 and of the suction chamber 24 exhibits the additional advantage that the suction ports 6 which advance with the vertically downwardly moving portion 23 of the conveyor 3 evacuate air from the gaps between neighboring panels 11 of the growing stack 18*a* to thus promote the gathering of panels into a stack having an optimum shape which is best suited for further processing, e.g., for wrapping into sheets of paper or foil and/or for packing in boxes or other types of receptacles. Evacuation of air from the spaces between neighboring panels 11 of the growing stack 18*a* renders it possible to move successive rear fold lines 22 into immediate proximity of the preceding fold lines and to thus form the growing stack 18*a* with a practically uninterrupted rear side.

The aforediscussed configuration of the upper side 126 of the bending means 26 (i.e., of the top portion of the main supporting means or table 16) ensures that the panels 11 of the growing stack assume a shape which can be best seen in FIG. 2, i.e., with the front fold lines 12 (visible in FIG. 2) and the rear fold lines 22 (concealed behind the row of front fold lines 12) having an arcuate shape which may but need not always be as pronounced as shown in FIG. 2. The generatrices of the upper side of each bending means 26 extend in the direction of the arrow 13. Bending or flexing of the fold lines 12 and of the panels 11 in a manner as shown in FIG. 2 is promoted by the aforementioned folding elements 14 with their shorter fingers 14*a* and longer fingers 14*b* in a distribution such as to ensure that the curvature of the fold lines 12 at least closely resembles the curvature of the respective upper side 126.

Each bending means 26 is divided into a plurality of sections (FIG. 2 shows that each bending means comprises a central section 26*b* with the respective apex 226 and two outer sections 26*a*, 26*c*) which define clearances or gaps 27 extending in the direction of the arrow 13. The purpose of the clearances 27 is to permit convenient deposition of successive fully grown stacks 18, 18*a*, 18*b* onto the first endless belt conveyor 38 of a stack evacuating unit 37 which is installed at a level below the stacking station 2. In addition, the clearances 27 render it possible to continue with the delivery of successive panels 11 to form a fresh growing stack (see the stack 18*b* in FIG. 3) while the table 16 is in the process of removing a fully grown stack from the station 2 and while the table is thereafter in the process of returning to a raised position at a level above that which is shown in FIG. 1, namely to a raised position in which the bending means 26 is located at or close to the level of the rotating brush 19 and the rotating folding elements 14.

The elevator for moving the table 16 up and down comprises a carriage 28 which is movable up and down along guide means 28*a* including one or more columns, and a motor 29 which can move the carriage 28 along the guide means 28*a*. The guide means 28*a* can support the conveyor 38 of the evacuating unit 37. The arrangement is preferably such that the motor 29 causes the carriage 28 to lower the table 16 and the bending means 26 at the rate of growth of the stack 18*a* thereon (FIG. 1), and to lower the table 16 with a fully grown stack thereon at a higher speed (if necessary) as soon as an auxiliary supporting means 33 has been caused to enter the stacking station 2 at a level immediately above the fully grown stack on the table 16. The auxiliary supporting means 33 can comprise two prongs each of which enters one of the respective pair of clearances 27 when the table 16, with the fully grown stack removed from its bending means 26, is returned to the raised position in which it can take over the growing stack (18*b* in FIG. 3) from the auxiliary supporting means 33. The latter is reciprocable in and counter to the direction of arrow 13 by a first moving means 34 and is also movable up and down by a second moving means 36 so that it can descend at the stacking station 2 at the exact rate of growth of the stack 18*b* thereon.

The signal to start the operation of the moving means 34 so as to shift the auxiliary supporting means 33 from the retracted position of FIG. 1 to the extended or operative position of FIG. 3 can be transmitted by a suitable counter (not shown) which counts the number of panels 11 and generates signals when the stack on the bending means 26 of the respective table 16 contains a predetermined number of panels 11. Signals from the counter further initiate the movement of a partitioning device 32 which is pivotable about the axis of a shaft 31 and enters between the topmost panel 11 of the fully grown stack (18*a* in FIG. 3) and the next-following panel 11 of the respective web 1. At such time, the prongs of the auxiliary supporting means 33 are free to advance beneath the next-following panel 11 of the web 1 (i.e., above the topmost panel of the fully grown stack) so that the web can continue to advance at the selected speed and its successive panels 11 accumulate on top of each other to form the growing stack 18*b* of FIG. 3.

The table 16 can descend beneath the stacking station 2 immediately upon introduction of the auxiliary supporting means 33 into the stacking station. The table 16 then deposits the fully grown stack (18*a* in FIG. 3) into the upper reaches of two endless bands which constitute or form part of the first conveyor 38 of the evacuating unit 37 and are positioned to enter the clearances 27 between the sections 26*a*–26*c* of the bending means 26 on the descending table 16. The upper reaches of the bands of the conveyor 38 then advance the fully grown stack 18*a* toward and onto the upper reach of the second endless belt conveyor 39 of the evacuating unit 37. Actual removal of the fully grown stack 18*a* from the bending means 26 of the lowered table 16 is preferably assisted by a hold-down device 41 which descends from the raised position of FIG. 1 to the operative position of FIG. 3 in which it exerts pressure upon the topmost panel of the fully grown stack 18*a* to thereby urge the lower portion of the stack against the upper reaches of the endless bands forming the conveyor 38. The hold-down device 41 can be reciprocated in and counter to the direction of arrow 13 to share at least the initial stage of movement of the fully grown stack 18*a* with the conveyor 38.

The descending table 16 causes the topmost panel 43*a* of the fully grown stack 18*a* to open up (because the lowermost panel of the growing stack 18*b* is held by the auxiliary supporting means 33) before the hold-down device 41 engages the stack 18*a* of FIG. 3, i.e., the device 41 actually bears against the next-to-the-topmost panel 11 of the stack 18. This enables a severing device 42 to move counter to the direction of arrow 13 (or to simply remain at a standstill while the stack 18*a* advances with the conveyor 38) to sever the trailing fold line 22 between the (former) topmost panel 43*a* of the stack 18*a* and the panel 11 immediately below it. This can be readily seen in FIG. 3. The panel 43*a* above the severing device 42 (which can constitute or include a thin rod, a length of wire or a strip of metallic or plastic material) then floats in the air adjacent the rightmost portion of the auxiliary supporting means 33 at the stacking station 2. The panel 43*a* is caused to underlie the adjacent panel of the stack 18*b* when the stack 18*b* has grown into a full stack which is deposited on the conveyor 38 and is in the process of advancing toward and onto the conveyor 39 of the evacuating unit 37. This will be described with reference to the fully grown stack 18*a* of FIG. 3 which also comprises a panel 43*a* extending forwardly from the next panel 11, namely from the panel which is the lowermost one of a preselected number minus one.

Each panel 43*a* which extends from the lower part of the growing stack (first on the auxiliary supporting means 33 and thereupon on the bending means 26 of the table 16) is caused to assume a predetermined orientation by being urged upwardly by one or more nozzles 46 (shown only in FIG. 3) which are provided on or form part of the table 16 and direct streams of air against the underside of the panel 43*a* in front of the bending means, at least shortly prior to transfer of the grown stack onto the conveyor 38. This ensures that the panel 43*a* is not folded and/or otherwise damaged or defaced but comes to rest flat on the upper reaches of the bands forming part of the conveyor 38 when the table 16 is lowered by the carrier 28 to transfer the fully grown stack 18*a* of FIG. 3 onto the conveyor 38. At such time, the panel 43*a* is flat or substantially flat and rests on the conveyor 38 ahead of the bulk of the respective fully grown stack 18*a*. To this end, the pulley at the discharge end of the conveyor 38 includes or constitutes a suction wheel 44 which attracts successive increments of the advancing panel 43*a* and causes such panel to enter the gap between the conveyor 38, 39. As the bulk of the stack 18*a* reaches and advances with the upper reach of the conveyor 39, the panel 43*a* is caused to underlie the next panel of the stack 18*a* on the conveyor 39. The latter advances the stack 18*a* to the next processing station, not shown.

The motor 29 causes the carriage 28 of the elevator means for the table 16 to lift the latter as soon as the fully grown stack 18*a* has been transferred onto the conveyor 38. At such time, the rising clearances 27 between the sections 26*a*–26*c* of the bending means 26 receive the prongs of the extended auxiliary supporting means 33 so that the table 16 accepts the growing stack 18*b* and the motor 34 can retract the auxiliary supporting means 33 to the position of FIG. 1. The growing stack 18*b* is then caused to conform to the curvature of the upper side 126 of the bending means 26, and the fold lines 12, 22 of the stack 18*b* assume the arcuate shapes shown for the fold lines 12 in FIG. 2.

The upper side of the bending means 26 on each table 16 can have a concave or a convex shape, as long as the folding elements 14 and the downwardly moving portion 23 of the conveyor 3 can cause the fold lines 12 and 22 to assume an arcuate shape and to thus convert the panels 11 into bodies each of which has a concave underside and a convex upper side or vice versa. It has been found that the gathering of panels into predictable zig-zag formations is facilitated if the bending means 26 of the tables 16 have convex upper sides, at least if the web 1 advances its panels in the form of a scalloped stream with partially overlapping panels.

The number of folding elements 14 for each bending means 26 can be reduced to three or two or increased to five or more without departing from the spirit of the invention.

An important advantage of the improved apparatus is that unpredictable deformation of stacks 18, 18*a*, 18*b*. and next-following stacks is prevented in a simple and efficient manner, regardless of the selected number of panels per fully grown stack. This is due to the provision of the bending means 26 and to the provision of folding elements 14 and conveyor portion 23 which cooperate to ensure that the respective rows of fold lines 2, 22 are tightly packed and that the curvature of such fold lines corresponds to that of the respective upper sides 126. Moreover, and since the stacks grow at a predictable rate and assume a predetermined optimum shape during each and every stage of their formation, the folding action of the elements 14 and other parts which act upon the growing add fully grown stacks is more reliable than if the stacks were permitted to assume shapes which depart from optimum configurations. Still further, the processing of successive fully grown stacks is simpler and more predictable because the processing instrumentalities at the next-following station or stations receive stacks each of which has a shape matching or closely approximating the desired optimum shape. It was further discovered that the improved apparatus is less likely to wrinkle the panels 11 of the stacks than heretofore known apparatus. Wrinkling could be caused by the folding elements 14 if the shape of growing stacks at the stacking stations 2 were permitted to depart from the predetermined shape.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of our contribution to the art and, therefore, such adaptations should and are intended to be comprehended within the meaning and range of equivalence of the appended claims.

We claim:

1. Apparatus for converting at least one running web of coherent panels into a succession of stacks with superimposed panels in zig-zag formation, comprising means for advancing the web longitudinally in a predetermined direction along a predetermined path; means for superimposing successive panels in a predetermined portion of said path to form a growing stack of superimposed panels in zig-zag formation with a lowermost panel and two rows of fold lines connecting each panel above the lowermost panel to the neighboring panels; and means for supporting the lowermost panel of the growing stack in said portion of said path, said supporting means having means for bending the fold lines of said rows to thereby impart to the lowermost panel and at least some panels close to the lowermost panel a concavo-convex configuration with resulting being of the fold lines adjacent said lowermost panel and said at least some panels close to the lowermost panel.

2. The apparatus of claim 1, wherein said advancing means includes means for transforming the web into a scalloped stream of partially overlapping panels.

3. The apparatus of claim 1, wherein said bending means has a convex upper side arranged to contact the lowermost panel of the growing stack.

4. The apparatus of claim 3, further comprising elevator means for moving said supporting means up and down toward and away from said portion of said path.

5. The apparatus of claim 1, wherein said bending means has an arcuate upper side arranged to contact the lowermost panel of the growing stack, said superimposing means including a plurality of folding elements operative to flex the fold lines of one of said rows so as to conform the curvature of the thus flexed fold lines of the one row to the curvature of said arcuate upper side.

6. The apparatus of claim 5, wherein the fold lines of the one row are located downstream of the fold lines of the other of said rows, as seen in said predetermined direction, said folding elements including rotary folding fingers and said superimposing means further comprising means for rotating said fingers.

7. The apparatus of claim 6, wherein said fingers include at least one longer finger and at least one shorter finger.

8. The apparatus of claim 7, wherein said folding elements include four folding fingers which are spaced apart from each other transversely of said predetermined direction.

9. The apparatus of claim 8, wherein said upper side has a substantially centrally located apex extending in said predetermined direction and said fingers include a shorter finger and a longer finger at each side of said apex.

10. The apparatus of claim 5 for simultaneously converting each of a plurality of running webs into a succession of stacks, wherein said advancing means includes means for advancing the webs along discrete substantially parallel paths and said supporting means includes discrete means for bending the fold lines in each growing stack, said superimposing means comprising a plurality of rotary folding elements for each of the webs and means for rotating all of said folding elements about a common axis.

11. The apparatus of claim 1, wherein said advancing means includes a conveyor disposed above a second portion of said path upstream of said predetermined portion.

12. The apparatus of claim 11, wherein said advancing means further includes means for transforming the web into a scalloped stream of partially overlapping panels not later than in said second portion of said path.

13. The apparatus of claim 11, wherein said conveyor includes an endless belt conveyor having an elongated upper reach and said bending means has an arcuate upper side arranged to contact the lowermost panel of the growing stack, said upper side having an apex in line with said upper reach and said superimposing means including at least one mobile folding element at each lateral side of said upper reach, said folding elements being arranged to flex successive fold lines of one of said rows so as to conform the curvature of the thus flexed fold lines of said one row to the curvature of said arcuate upper side.

14. The apparatus of claim 11 for converting a running web with parallel fold lines between successive panels, wherein said conveyor has means for attracting the web in the regions of fold lines in the second portion of said path.

15. The apparatus of claim 14, wherein said attracting means includes suction ports provided in said conveyor and a suction chamber communicating with the suction ports adjacent the second portion of said path.

16. The apparatus of claim 1, wherein said advancing means includes an endless belt conveyor disposed below a second portion of said path upstream of said predetermined portion, said conveyor having a substantially vertical downwardly moving portion adjacent the other row of fold lines and means for attracting successive fold lines of the other row and for urging such fold lines downwardly toward said bending means.

17. The apparatus of claim 16, wherein said attracting means includes suction ports in said conveyor and a suction chamber communicating with the suction ports in said portion of said conveyor.

18. The apparatus of claim 1, wherein said bending means includes a plurality of sections spaced apart from one another transversely of said predetermined direction and defining clearances, and further comprising elevator means for moving said supporting means and said sections of said bending means up and down toward and away from the predetermined portion of said path so as to lower a fully grown stack and to thereupon return to a raised position at said predetermined portion of the path, auxiliary supporting means receivable in said clearances, and means for moving said auxiliary supporting means to and from an operative position beneath said predetermined portion of said path in which said auxiliary supporting means is in register with said clearances and supports the lowermost panel of a fresh growing stack preparatory to and during lowering of said first named supporting means, said auxiliary supporting means being received in said clearances, when said first named supporting means assumes said raised position, to be thereupon moved away from said operative position by the respective moving means.

19. The apparatus of claim 1, further comprising elevator means for moving said supporting means up and down toward and away from said predetermined portion of said path so that the supporting means can lower a fully grown stack, and further comprising means for separating the topmost panel of the fully grown stack on said supporting means from the next-following panel of the running web, and evacuating means arranged to accept fully grown stacks from said supporting means, particularly in response to downward movement of said supporting means.

20. The apparatus of claim 19, wherein said evacuating means comprises at least one conveyor and said separating means comprises means for breaking the web along the fold line between the topmost panel of the fully grown stack and the next-following panel of the running web.

21. The apparatus of claim 19, wherein said supporting means includes means for urging the next-following panel of the running web upwardly.

22. The apparatus of claim 21, wherein said urging means includes at least one nozzle arranged to blow compressed air against the underside of the next-following panel of the running web.

23. The apparatus of claim 19, wherein said evacuating means includes a first conveyor arranged to receive successive fully grown stacks from said supporting means and a second conveyor arranged to receive stacks from said first conveyor, said first conveyor having a discharge end adjacent said second conveyor and comprising means for changing the orientation of the lowermost panel of each fully grown stack during transfer of such stack from the first onto the second conveyor.

24. The apparatus of claim 23, wherein said orientation changing means includes a rotary suction wheel.

* * * * *